US007572157B2

(12) United States Patent
Zhu

(10) Patent No.: US 7,572,157 B2
(45) Date of Patent: Aug. 11, 2009

(54) SPINDLE MOTOR CONNECTOR AND METHOD OF MAKING THE SAME

(75) Inventor: Yu Zhu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/313,168

(22) Filed: Nov. 17, 2008

(65) Prior Publication Data

US 2009/0130911 A1 May 21, 2009

(30) Foreign Application Priority Data

Nov. 16, 2007 (CN) ..... 2007 2 0042305 U

(51) Int. Cl.
*H01R 4/48* (2006.01)

(52) U.S. Cl. ..... 439/862; 439/752

(58) Field of Classification Search ..... 439/862, 439/752, 23–26

See application file for complete search history.

(56) References Cited

U.S. PATENT DOCUMENTS 3,702,456 A * 11/1972 Patton ..... 439/404
4,194,805 A * 3/1980 Ayer et al. ..... 439/465
4,682,840 A * 7/1987 Lockard ..... 439/874
5,314,355 A * 5/1994 Halvonik ..... 439/638
6,007,387 A * 12/1999 Uchiyama ..... 439/736
6,315,620 B1 * 11/2001 Moir et al. ..... 439/862
6,433,956 B1 * 8/2002 Peters et al. ..... 360/97.01
6,652,324 B2 11/2003 Maiers et al.

* cited by examiner

*Primary Examiner*—Neil Abrams
*Assistant Examiner*—Phuong Nguyen
(74) *Attorney, Agent, or Firm*—Wei Te Chung

(57) ABSTRACT

A spindle motor connector (1) is adapted for making electrical connection between a spindle motor and a PC board in HDD, which is mounted below the spindle motor. Said spindle motor connector (1) has a step-like insulated housing (10) with passageways (105) formed thereon, and a plurality of contact terminals (11) are formed to receive in said passageways (105), said spindle motor connector (1) further includes a removable cover (12) with engagement portion to secure the removable cover (12), the contact terminals (11) and the insulated housing (10) together. With this new design, the mold structure and the manufacturing progress can be improved.

17 Claims, 7 Drawing Sheets

SPINDLE MOTOR CONNECTOR AND METHOD OF MAKING THE SAME

BACKGROUND OF THE INVENTION

1. Field of the Invention

The present invention relates to a spindle motor connector configured with a housing in which contact terminals are assembled and positioned thereof by means of a removable cover for efficient and cost-effective manufacturing.

2. Description of Related Art

Spindle motor, also sometimes called spindle shaft, is used to drive the hard disk platters, allowing the hard disk drive (HDD) to rotate in such a way that data can be retrieved therefrom and stored therein. And spindle motor connector is just the kind of connector for making electrical connection between the spindle motor and a PC board in HDD, which is mounted below the spindle motor.

Referring to FIG. 1, a prior art spindle motor connector 1' is shown. The connector 1' has a tailored housing in conform to the geometry of the configuration of a HDD such that a base portion of a housing is offset from a mating portion of the housing. In addition, contact terminal passages 101' are located in one level, while the mating portion is located on another level making the manufacturing process really complicated to be cost-effective.

U.S. Pat. No. 6,652,234 issued to Maiers et al on Nov. 25, 2003 discloses a pertinent connector. According to Maiers, a self-biasing spindle motor connector (such as 200) for a disc drive (such as 100) is disclosed. The spindle motor connector (such as 200) includes a body portion (such as 202) and a plurality of alloy contacts (such as 204) extending away from the body portion. The connector may comprise a crush rib (such as 206) extending from at least one side of the body portion and making contact with a vertical wall (such as locating edge 208) of a base plate (such as 102) of the disc drive. The crush rib ensures that the connector is properly biased to a reference edge and situated in relation to the base plate and the disc drive printed circuit board. An x-y control boss (such as 212) prevents the connector from moving in the x-y directions while the crush rib prevents the connector from rotational movement. The connector may also include a rotational boss (such as 216) that is inserted into a rotational control hole of the base plate to prevent rotational movement of the connector. However, the contact terminal passages are generally formed by the same way as what disclosed in FIG. 1, and which does not address the manufacturing process in question.

Hence, a spindle motor connector with improved molding and assembling structure is highly desired to overcome the disadvantages of the related arts.

SUMMARY OF THE INVENTION

Accordingly, the object of the present invention is to provide a spindle motor connector with improved molding and assembling structure to make it convenient.

In order to achieve the object set forth, a spindle motor connector has a step-like insulated housing with passageways formed thereon, and a plurality of contact terminals are formed to hold in said passageways, said spindle motor connector further includes a removable cover with engagement portion to secure the removable cover, the contact terminals and the insulated housing together. With this new separable design of said insulated housing, the mold structure and the manufacturing progress can be improved.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
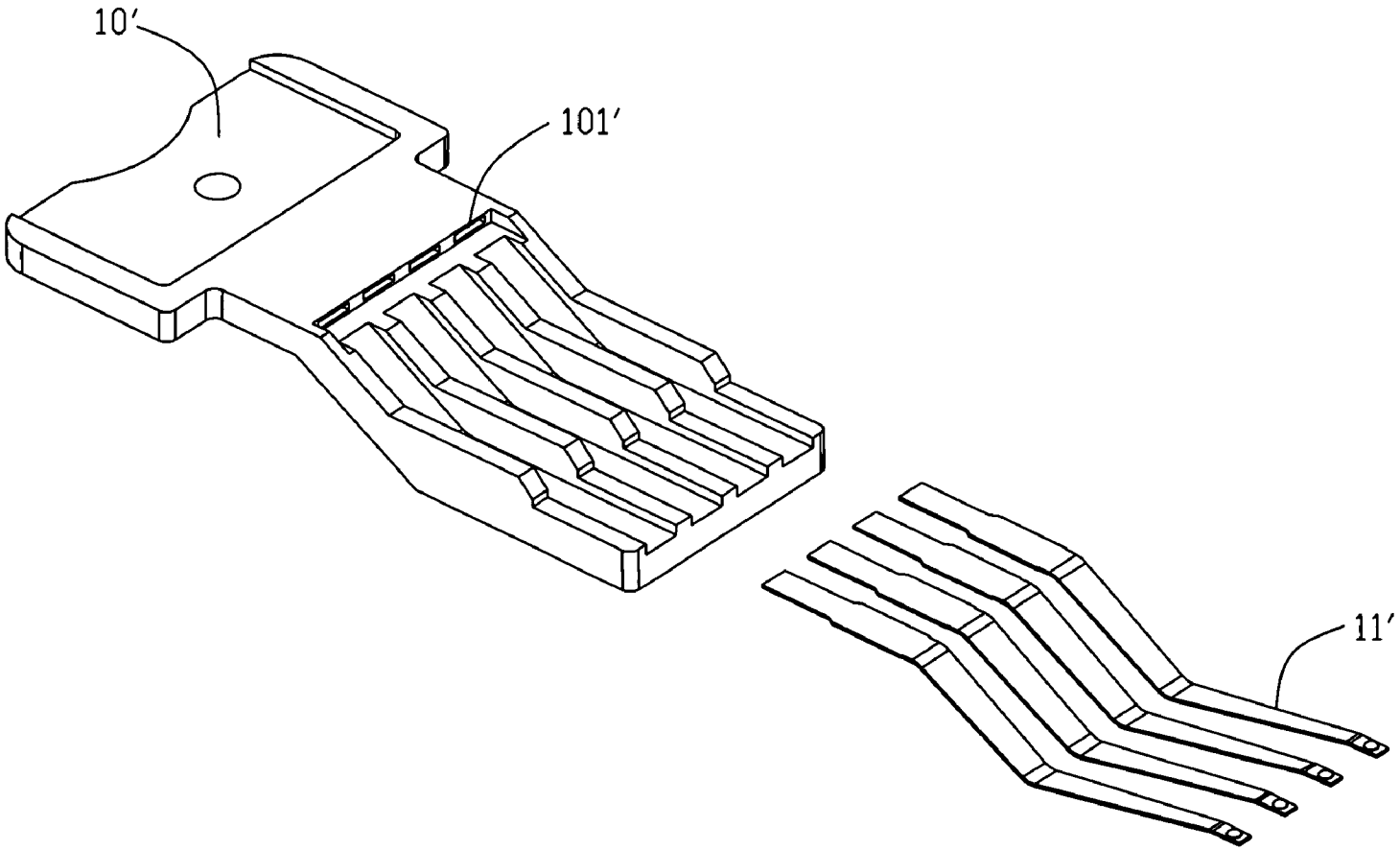
FIG. 1 is an exploded, perspective view of the spindle motor connector of the prior art.
Figure 2:
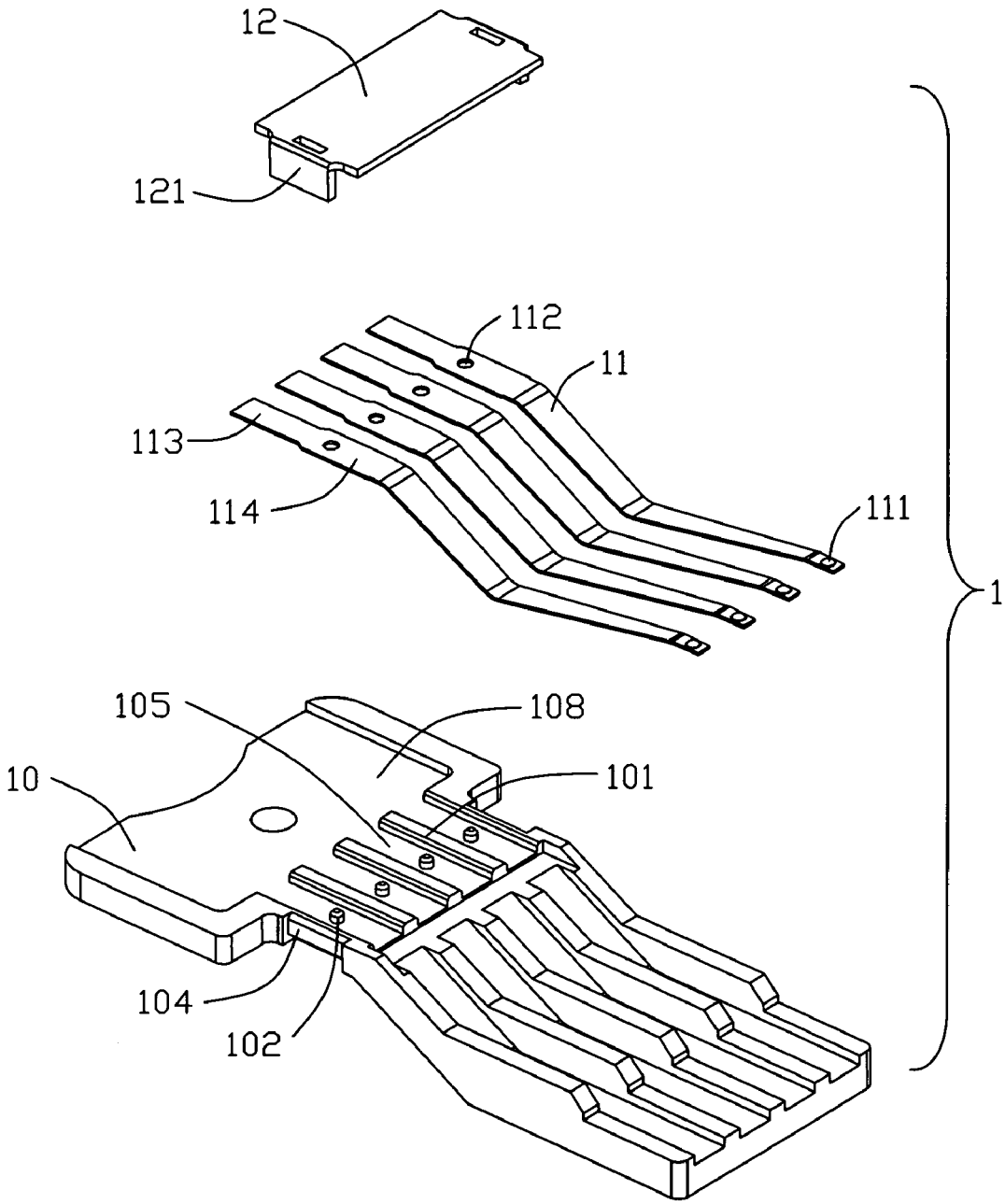
FIG. 2 is an exploded, perspective view of the spindle motor connector of an embodiment of the present invention.

Referring to FIG. 2, an spindle motor connector 1 comprises an insulated housing 10, a plurality of contact terminals 11 retained in said insulated housing 10 and a removable cover 12 that is engaged with the insulated housing 10.

Figure 3:
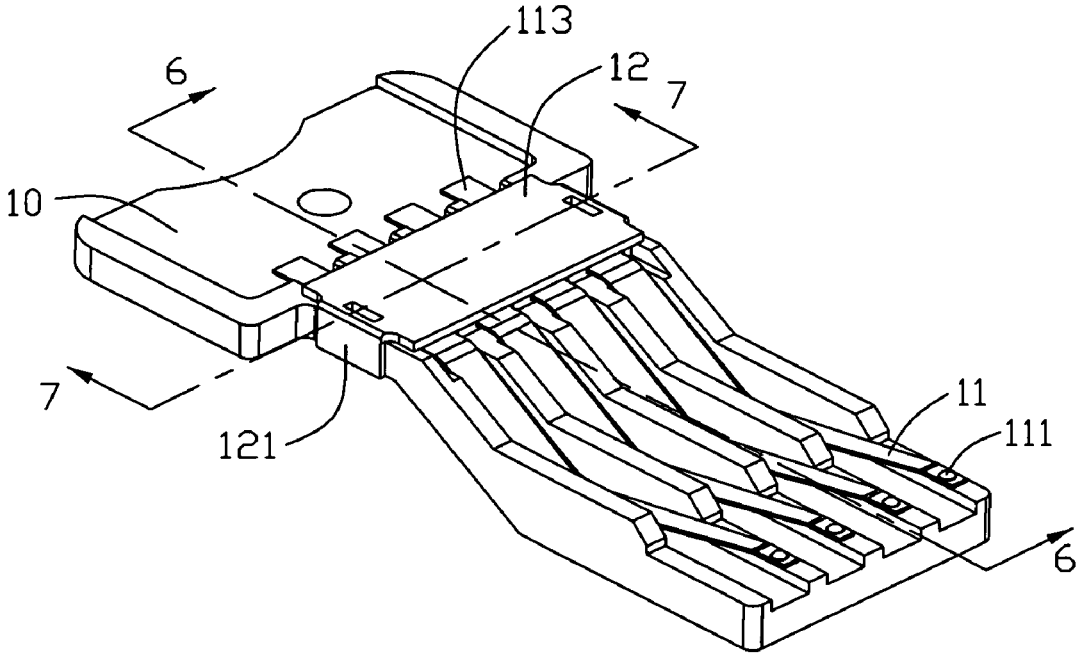
FIG. 3 is an assembled, perspective view of the spindle motor connector as shown in FIG. 2.
Figure 4:
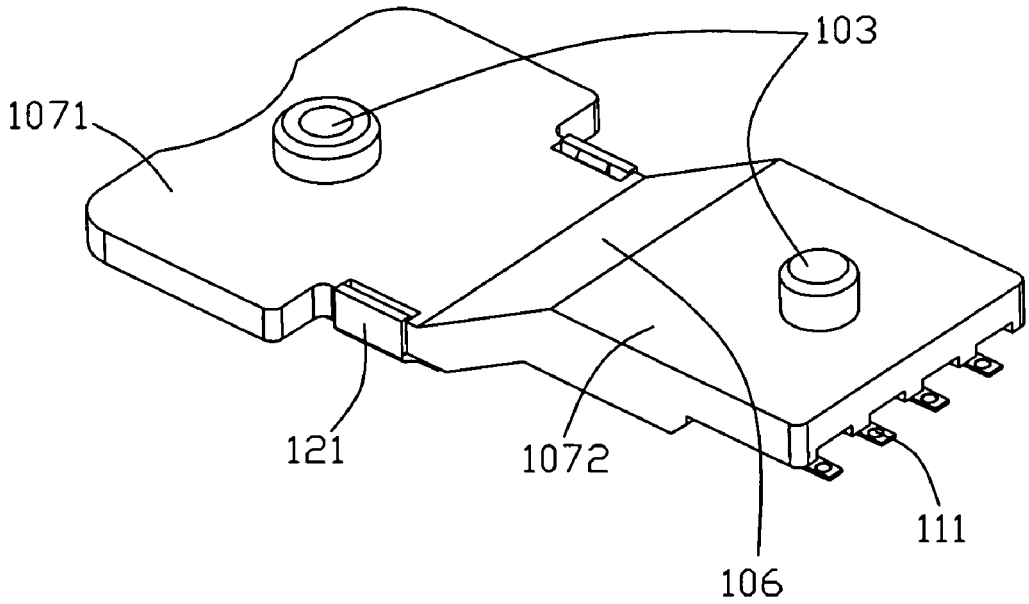
FIG. 4 is another assembled, perspective view of the spindle motor connector as shown in FIG. 3.
Figure 5:
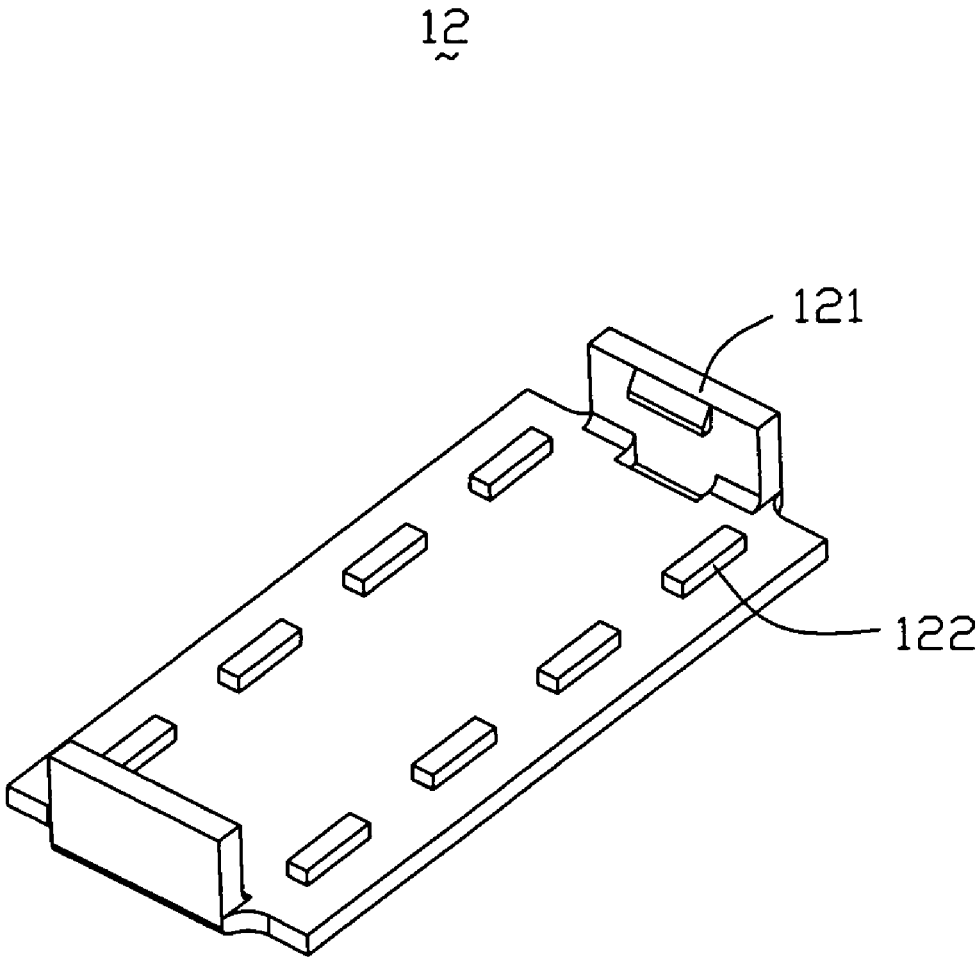
FIG. 5 is a perspective view of the removable cover as shown in FIG. 2.
Figure 6:
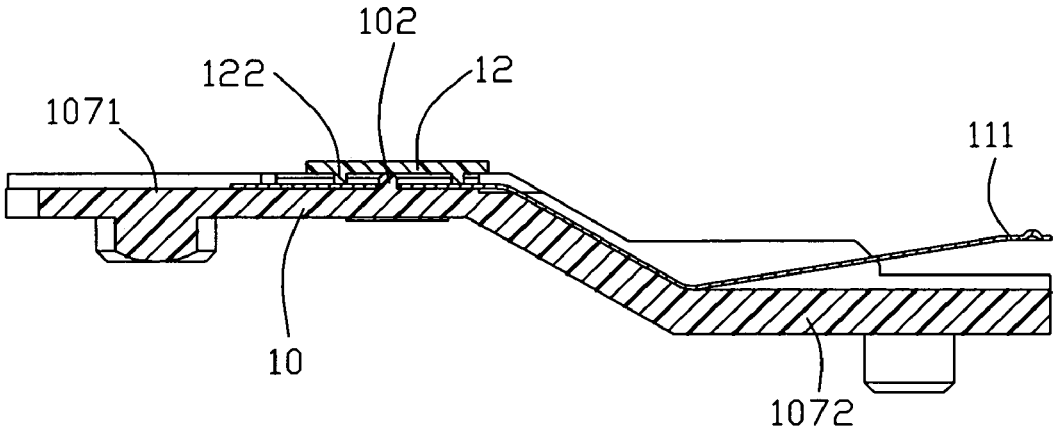
FIG. 6 is a cross-section view taken along line 6-6 of FIG. 3.
Figure 7:
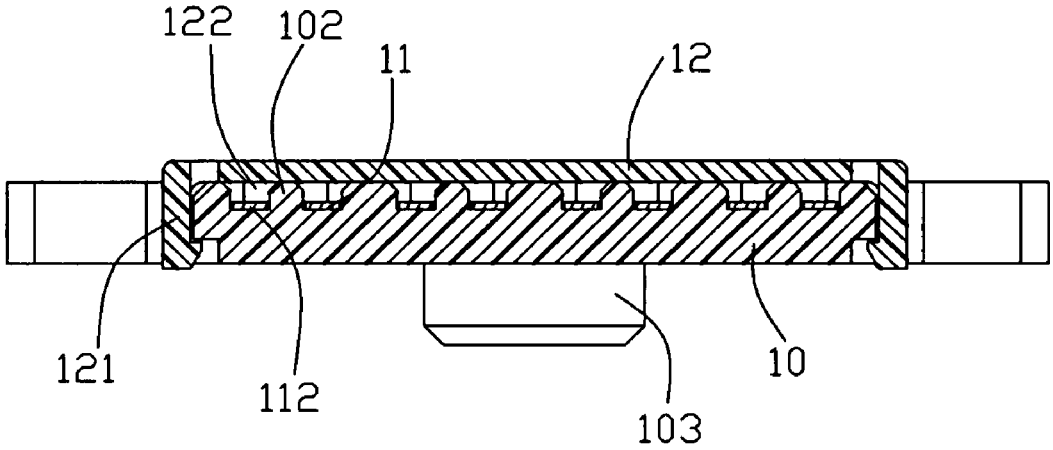
FIG. 7 is a cross-section view taken along line 7-7 of FIG. 3.

Referring to FIGS. 2-4, said insulated housing 10 is a step-like board, forms a base portion 1071 located in a first level, and a mating portion 1072 located in a second level which is offset from the first level, a transition portion 106 interconnecting the base portion 1071 and the mating portion 1072. A mating interface 108 is defined on one board side of said insulated housing 10, and the opposite side of said mating interface 108 is defined as a back face 106. Elongated ribs 101 are stood side by side on the mating interface 108 and said removable cover attached to the base portion 1071 defines jointly a plurality of passageways 105 thereof. Two positioning posts 103 are further formed on both the base portion 1071 and the mating portion 1072 of the back face 109 for positioning on different levels.

Still referring to FIGS. 2-4, said contact terminals 11 are assembled into corresponding passageway 105 forms two opposite bending (step-like), and each terminal 11 comprises a first contact portion 111, a second contact portion 113 and a contact engaging portion 114 between both of the first and the second contact portion (111,113). Said contact terminal 11 is in the form of longitudinal sheet with a aperture 112 stuck on said contact engaging portion 114. Corresponding first protruding portion 102 is formed in the passageway 105 to locate the contact terminal 11 into the passageway 105. Comparing with some interferential-restrained prior art, said restraint through the aperture 112 and the first protruding portion 102 can make better performance in such vibrate environment for a long time.

Referring to FIGS. 2-7, said removable cover 12 has a housing engagement portion, such as a lock lever 121, to secure the removable cover 12, the contact terminals 11 and the insulated housing 10 together. And a lock portion 104 is formed on the insulated housing 10 accordingly. In assembling process, contact terminals 11 are assembled into said passageways 105 and having their contact engaging portion 114 located above said mating interface 108 of said mating portion 1072 with all the contact terminals 11 in alignment with said elongated ribs 101, then said removable cover 12 is stuck on the contact engaging portion 114 and making engagement with said insulated housing 10. On the two longitudinal sides of the first protruding portion 102 in each passageway 105, second protruding portions 122 are formed to press on the contact terminal 11, so as to make a full and firm holding to the contact terminals 11. With this new removable cover 12, the mold of insulated housing 10 can be formed without slippers so as to improve the mold structure and the manufacturing progress.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A spindle motor connector, comprising:

a insulated housing having a base portion located in a first level, and a mating portion located in a second level which is offset from the first level, a transition portion interconnecting the base portion and the mating portion;

a removable cover attached to the base portion having elongated ribs standing side by side forming a plurality of passageways thereof; and a plurality of contact terminals assembled into the passageways and having their contact engaging portion located above a mating interface of the mating portion;

first protruding portion is defined in each passageway, and corresponding aperture is formed on each contact terminal; second protruding portions are formed on said removable cover to stick on the contact terminals.

2. The spindle motor connector as claimed in claim 1, wherein a plurality of contact terminals are assembled into said passageways and having their contact engaging portion located above a mating interface of said mating portion.

3. The spindle motor connector as claimed in claim 2, wherein said cover is assembled to a neck portion of said upper horizontal section.

4. The spindle motor connector as claimed in claim 3, wherein said cover includes a pair of latches grasping two sides of the neck portion.

5. The spindle motor connector as claimed in claim 4, wherein each passageway holds two second protruding portions, and said first protruding portion is set between said two second protruding portions.

6. The spindle motor connector as claimed in claim 5, wherein the opposite side of the mating interfaces defines a back face, positioning posts are formed on both the base portion and the mating portion of the back face.

7. The spindle motor connector as claimed in claim 6, wherein said contact terminals have the form of longitudinal sheet.

8. A method of making a spindle motor connector comprising:

A. providing a insulated housing having a base portion located in a first level, and a mating portion with elongated ribs located in a second level which is offset from the first level, a transition portion interconnecting the base portion and the mating portion;

B. providing a plurality of contact terminals which each defines a contact engaging portion;

C. mounting the contact terminals to the insulated housing by attaching a removable cover to the base portion such that the contact engaging portions are arranged within the elongated ribs of the mating portion;

D. said base portion further comprises one first protruding portion on the path of each contact terminal, and each of said contact terminals forms a aperture on the contact engaging portion in alignment with said first protruding portion and said removable cover forms at least a second protruding portion.

9. A method as claimed in claim 8, wherein said cover includes a pair of latches grasping two sides of the neck portion.

10. A method as claimed in claim 9, wherein said removable cover further forms at least two second protruding portions on the path of each contact terminal, and said first protruding portion is set between the second protruding portions.

11. An electrical connector comprising:

a unitary insulative housing defining an upper horizontal section and a lower horizontal section linked by an slanted section therebetween in a front-to-back direction;

a plurality of juxtaposed passageways extending along said front-to-back direction passing said upper horizontal section, said slanted section and said lower horizontal section and exposed upwardly to an exterior;

a plurality of contacts disposed in the corresponding passageways, respectively, each of said contacts including a stationary segment located on the upper horizontal section, an oblique segment on the slanted section, and a deflectable segment on the lower horizontal section;

an insulative cover assembled to the housing and covering the stationary segment to retain said contact in position with regard to the housing in at least a vertical direction and said base portion further comprises one first protruding portion and said removable cover forms at least a second protruding portion.

12. The electrical connector as claimed in claim 11, wherein a pair of posts downwardly extend from bottom faces of said upper horizontal section and said lower horizontal section, respectively.

13. The electrical connector as claimed in claim 11, wherein said cover is assembled to a neck portion of said upper horizontal section.

14. The electrical connector as claimed in claim 13, wherein said cover includes a pair of latches grasping two sides of the neck portion.

15. The electrical connector as claimed in claim 11, wherein the housing and the cover are combined as one insulative part, and one of said insulative part and said contact defines a plurality of protrusions and the other defines a plurality of openings to receive said protrusions for retention between the contact and the insulative part in said front-to-back direction.

16. The electrical connector as claimed in claim 15, wherein the openings are formed in the contacts.

17. The electrical connector as claimed in claim 16, wherein the protrusions are formed on the housing.

* * * * *